US006925945B2

(12) United States Patent
Babick et al.

(10) Patent No.: US 6,925,945 B2
(45) Date of Patent: Aug. 9, 2005

(54) LEG ATTACHMENT AND METHOD FOR MANUFACTURING SAME

(75) Inventors: Tod G. Babick, Grand Rapids, MI (US); Denis H. Hoffman, Spring Lake, MI (US); Robert A. Benefiel, Coopersville, MI (US)

(73) Assignee: JSJ Furniture Corporation, Spring Lake, MI (US)

( * ) Notice: Subject to any disclaimer, the term of this patent is extended or adjusted under 35 U.S.C. 154(b) by 53 days.

(21) Appl. No.: 10/164,860

(22) Filed: Jun. 7, 2002

(65) Prior Publication Data

US 2003/0226481 A1 Dec. 11, 2003

(51) Int. Cl.[7] ..... A47B 13/00

(52) U.S. Cl. ..... 108/157.1; 108/156; 108/158.11; 248/188

(58) Field of Search ..... 108/156, 157.1, 108/153.1, 158.11, 158.13, 186.1, 27; 248/188

(56) References Cited

U.S. PATENT DOCUMENTS 3,687,092 A * 8/1972 Manning ..... 108/156
4,242,969 A * 1/1981 Checkwood et al. ... 108/158.11
4,413,570 A * 11/1983 Haigh ..... 108/158.13
4,723,578 A * 2/1988 Mordarski et al. ..... 138/97
4,793,579 A * 12/1988 Finkelstein et al. ..... 248/188
4,805,541 A * 2/1989 Drane et al. ..... 108/27
4,848,245 A * 7/1989 Piretti ..... 108/156
4,867,610 A * 9/1989 Diffrient ..... 248/188
5,153,052 A * 10/1992 Tanaka et al. ..... 428/212
5,207,163 A * 5/1993 Kojima ..... 108/158
5,479,864 A * 1/1996 Kemp ..... 108/27
5,533,788 A * 7/1996 Nottingham et al. .... 297/440.1
5,934,203 A * 8/1999 Glass ..... 108/156

* cited by examiner

*Primary Examiner*—José V. Chen
(74) *Attorney, Agent, or Firm*—Warner Norcross & Judd

(57) ABSTRACT

A leg attachment mechanism and a method of manufacture for an article of furniture including a bracket attached to the article of furniture and an expandable post attached to the bracket. The leg includes a receptacle of sufficient dimension to receive the post. The leg is attached to the post by fitting the receptacle over the post and then expanding the post to forcefully engage the walls of the leg defining the receptacle. The post preferably includes a flexible wall that is movable outwardly by rotation of a threaded element, such as a set screw. A foam overmold is preferably formed over the edge of the article of furniture and the bracket. The overmold preferably includes an undercut boot that closely receives upper end of the leg.

35 Claims, 9 Drawing Sheets

LEG ATTACHMENT AND METHOD FOR MANUFACTURING SAME

BACKGROUND OF THE INVENTION

The present invention relates to furniture and, more specifically, to furniture leg attachment mechanisms and related components.

Many pieces of furniture have rigidly attached legs. Pieces of furniture with long legs, such as tables, are often delivered to the end consumer without the legs attached. The furniture takes up less space and is easier to transport without the legs already attached. The furniture suppler or the end consumer must then attach the legs to the furniture.

Typically legs are attached to furniture using brackets and screws. Several problems result from this type of leg attachment. One problem is that it can be complicated to assemble the legs to the furniture. With bracket and screw assemblies, it is necessary to work with several small parts. It is often difficult for an end consumer to figure out where each part needs to be connected, and there is a danger of losing some of the parts, especially smaller parts like screws. Another problem is the ability of the furniture to withstand force. If the bracket and screw assembly is not robust enough or the legs are not properly attached to the furniture, the furniture may buckle or collapse under heavier loads. Yet another problem with bracket and screw assemblies is that they are aesthetically unpleasing. Often, these assemblies are plainly visible after the legs are assembled, for example, from the side.

SUMMARY OF THE INVENTION

The aforementioned problems are overcome by the present invention wherein an attachment assembly is provided with a post that is affixed to the undersurface of an article of furniture. The post is generally wedge-shaped and is configured to be fitted within an opening in the upper end of the leg. The post is expandable to bind against the inner surfaces of the leg, creating a secure connection.

In a preferred embodiment, the post is generally triangular in cross section and includes an expansion wall that is capable of outward movement to increase the cross-sectional size of the post. The post is preferably a one-piece component with the expansion wall being an integral portion of the post. The post preferably includes a set screw that is threaded through the expansion wall and engages a fixed portion of the post. Movement of the set screw causes the expansion wall to swing inwardly and outwardly with respect to the remainder of the post. This causes all three walls of the post to bind against the corresponding inner surfaces of the leg creating a secure connection. The leg preferably defines an opening permitting access to the set screw.

In a more preferred embodiment, the leg attachment mechanism includes a mounting bracket that is separate from the post. The bracket defines a series of mounting holes for securing the bracket to the undersurface of the article of furniture using conventional fasteners. The bracket defines a post hole for securing the post to the bracket. The post hole is positioned so that the post is disposed over the corner fastener.

In an even more preferred embodiment, the leg attachment mechanism includes a foam overmold that covers the bracket and forms a boot for the upper end of the leg. The foam overmold is preferably configured to hide the entire leg attachment mechanism once assembled. The overmold also preferably provides a foam edge for at least a portion of the article of furniture.

In a second aspect, the present invention provides a method for manufacturing the leg attachment mechanism including the steps of (a) attaching a bracket to the article of furniture; (b) overmolding the bracket with foam using a plug in the mold to define a void for the post wherein the foam forms a boot on the underside of the article of furniture; (c) attaching the post to the bracket; (d) inserting a hollow part of a leg around the post; and (e) expanding the post to force the post to bind against the inner walls of the leg, thereby firmly connecting the leg to the article of furniture. In a preferred embodiment, the plug is manufactured from a flexible and resilient material. As the mold is closed, the plug is compressed causing it to bulge outwardly forming a somewhat undercut boot. When the mold is opened, the plug returns to its original shape, permitting it to be withdrawn through the narrowing opening of the molded boot foam.

The present invention provides several advantages over prior leg attachment mechanisms. First, the leg is easily attached to the article of furniture because a minimum number of parts are involved. In the preferred embodiment, only a single set screw is tightened to attached each leg. Also, it is difficult to incorrectly install the leg. In a preferred embodiment, the leg defines an opening permitting access to the set screw. The set screw will be accessible only when the leg is properly installed. Second, the connection between the leg and the post is highly secure. Because the post is wedge shaped, there is a high degree of engagement between the post and the inner surfaces of the leg. As the post expands, all three walls of the post are driven more forcefully against the corresponding surfaces of the leg. Third, because the bracket and post are separate pieces, the bracket can be secured to the article of furniture by a fastener located immediately beneath the leg. This reduces any "fulcrum" effect that might be caused by an offset fastener. Fourth, the use of a separate post permits the bracketed to be overmolded before the post is attached. This eliminates the concern that the mold will be damaged by the post. Further, the flexible plug permits an undercut void to be formed to receive the leg. This eliminates the need for a conventional draft angle in the mold and ultimately provides a tighter fit of the overmold around the leg. Fifth, the assembly is aesthetically pleasing because the leg attachment mechanism is hidden beneath foam.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
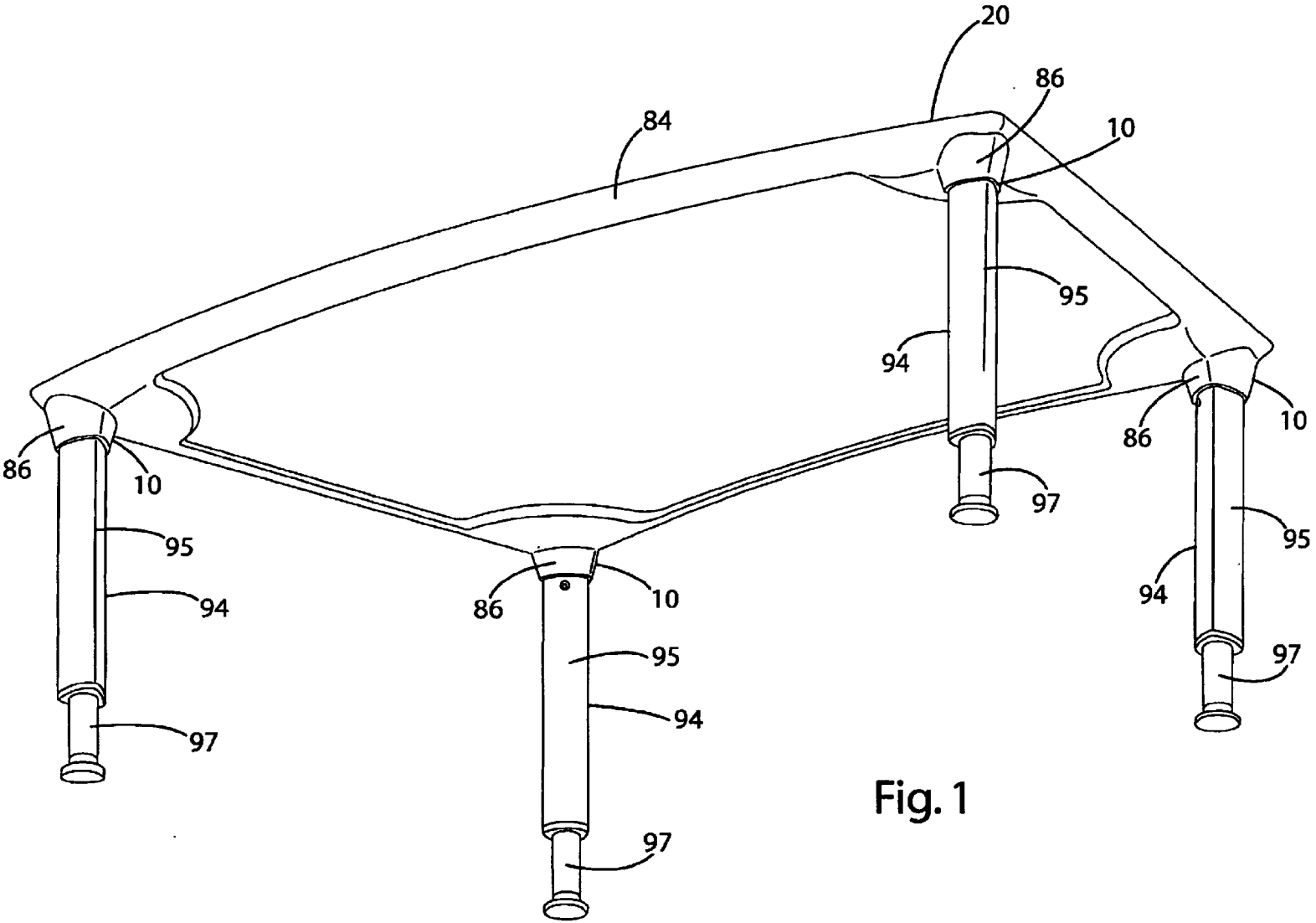
FIG. 1 is a perspective view of a table including the leg attachment mechanism of the present invention.
Figure 2:
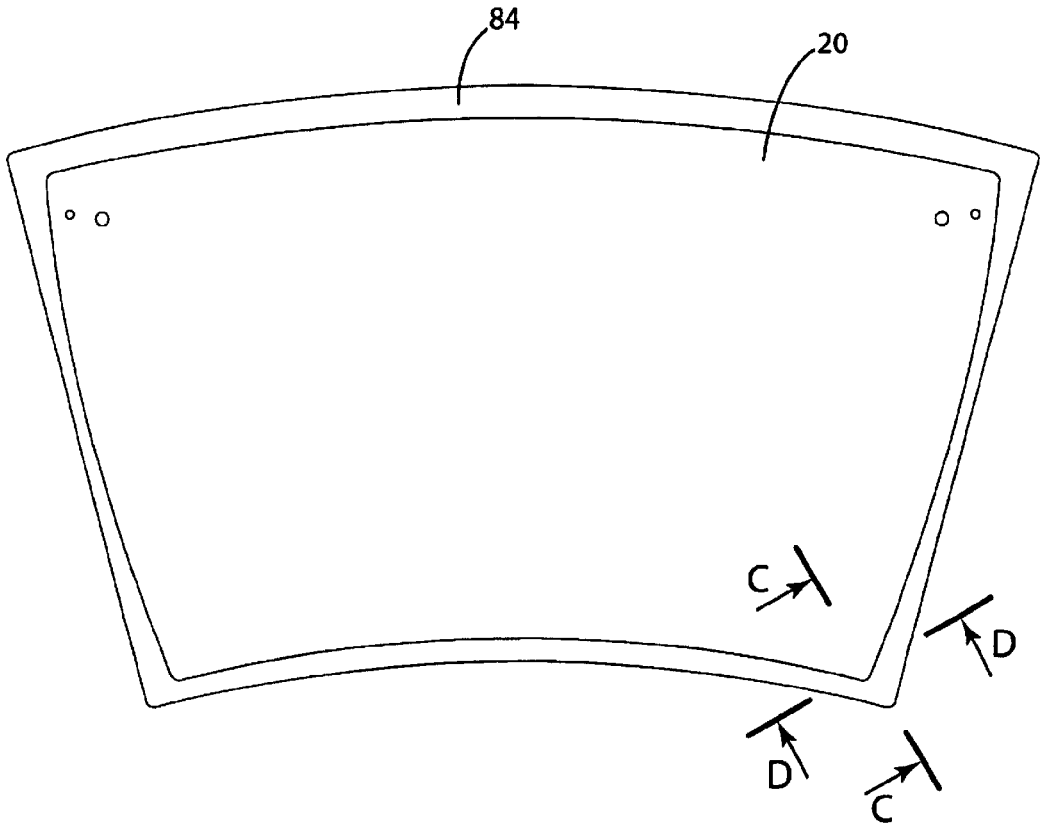
FIG. 2 is a top view of the table.
Figure 3:
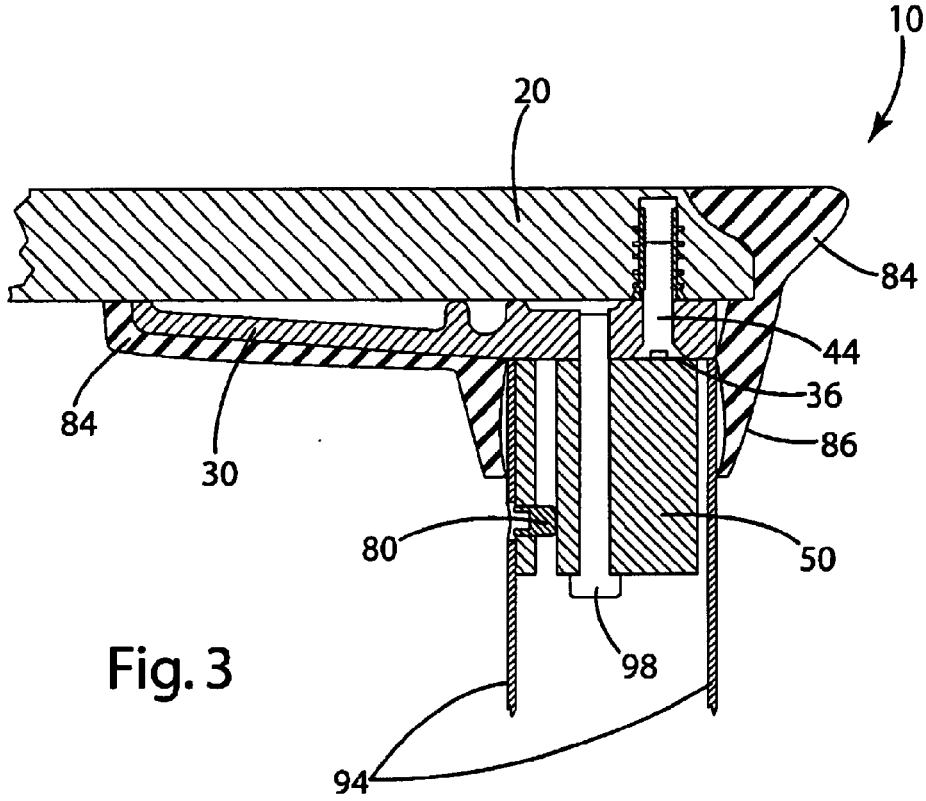
FIG. 3 is a sectional view of the leg attachment mechanism taken along the line C—C in FIG. 2.
Figure 4:
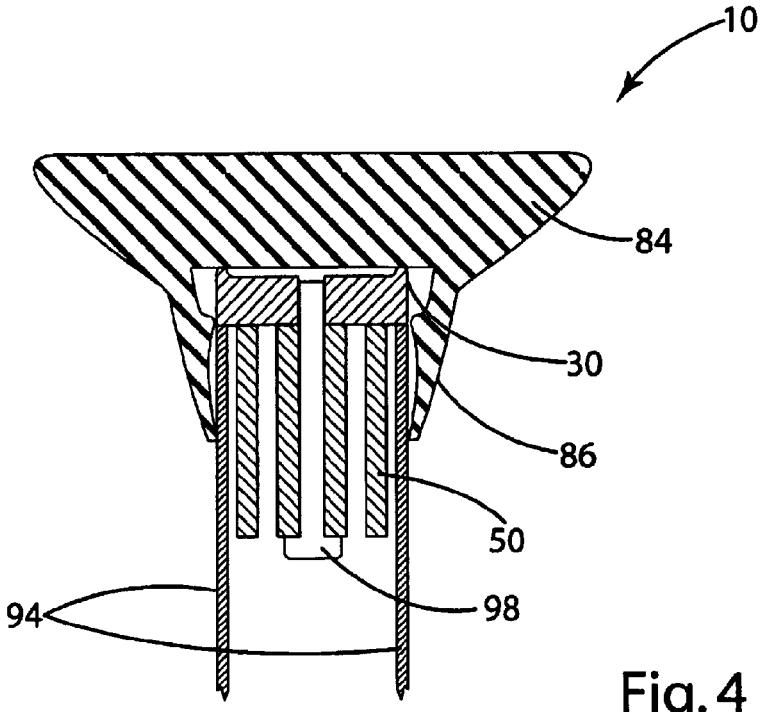
FIG. 4 is a sectional view of the leg attachment mechanism taken along the line D—D in FIG. 2.

A table 20 incorporating a leg attachment mechanism 10 in accordance with a preferred embodiment of the present invention is shown in FIG. 1. The leg attachment mechanism 10 is intended to be used with an article of furniture to allow for the easy attachment of legs to the article of furniture. FIG. 1 shows the leg attachment mechanism 10 connected to a table 20, with one leg attachment mechanism 10 located in each corner of the table 20. The leg attachment mechanism 10 is, however, well suited for use in attaching legs to a wide variety of articles of furniture. As shown in FIGS. 2–4, the leg attachment mechanism 10 generally includes a bracket 30, screws 44 for attaching the bracket 30 to the table 20, a post 50, and a bolt 98 for attaching the post to the bracket. The leg attachment mechanism 10 may optionally have foam 84 surrounding part of the table 20, the bracket 30, and part of the post 50. In use, the post 50 is fitted within the leg 94 and expanded by set screw 80 to bind against the inner surfaces of the leg 94.

I. Construction

Figure 5:
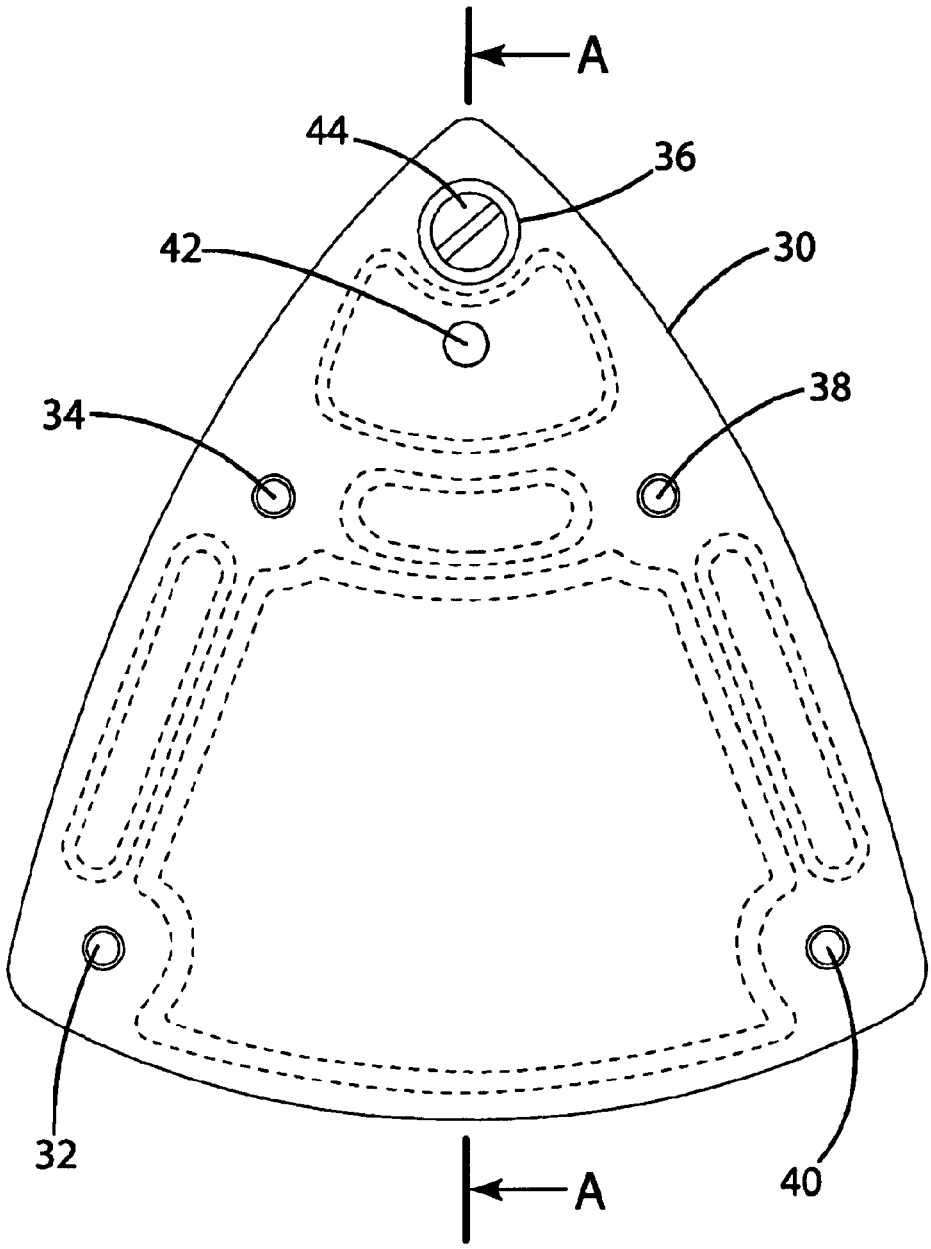
FIG. 5 is a top view of the bracket.

As noted above, the leg attachment mechanism 10 includes a bracket that is mounted to the undersurface of the table 20. The table 20 preferably includes four brackets 30, one located in each corner of the table 20. In the illustrated embodiment, the brackets 30 provide for attachment of a separate leg 94 in each corner of table 20, but it will be readily apparent to those skilled in the art that the location of the brackets may vary from application to application depending on the desired location of the legs. The bracket 30 is generally triangular and preferably is manufactured (e.g. cast) of aluminum. As shown in FIG. 5., the bracket 30 preferably defines five holes 32, 34, 36, 38, 40 to secure the bracket 30 to the table 20, for example, using conventional fasteners such as screws. Hole 36 is preferably placed near the tip of the bracket 30, where it will lie beneath the installed post 50. This positioning greatly reduces any fulcrum effect that might be created by an offset fastener and, accordingly, reduces the likelihood that the bracket 30 might peel away from the table 20 under heavy loads. The bracket 30 also has a tapped or threaded hole 42 to bolt the post 50 to the bracket 30. Alternatively, the bracket 30 could contain a different number of screw holes, and the screw holes 32, 34, 36, 38, and 40 and the bolt hole 42 could be placed in different locations. As another alternative, the bracket 30 may be designed to accommodate other mechanisms for attaching it to the table 20 as apparent to those skilled in the furniture art. The bracket 30 also preferably defines relieved portions 31 to reduce the weight and amount of material required to form the bracket 30. The size, location and arrangement of relieved portions will vary from application to application depending in large part on the strength required by the bracket and the positioning of the screw holes or other mounting devices.

Figure 6:
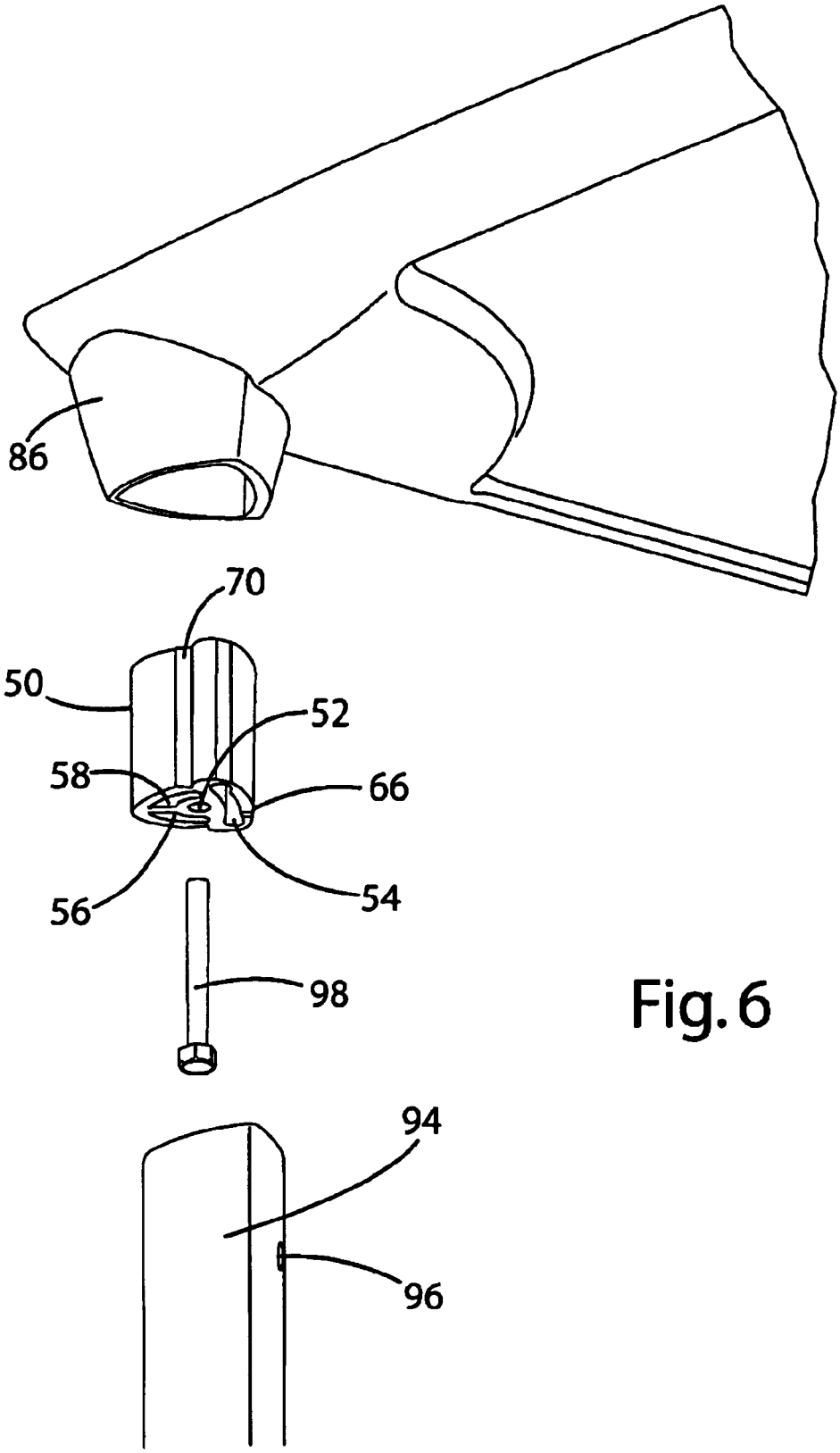
FIG. 6 is a perspective exploded view of the leg attachment mechanism.
Figure 7:
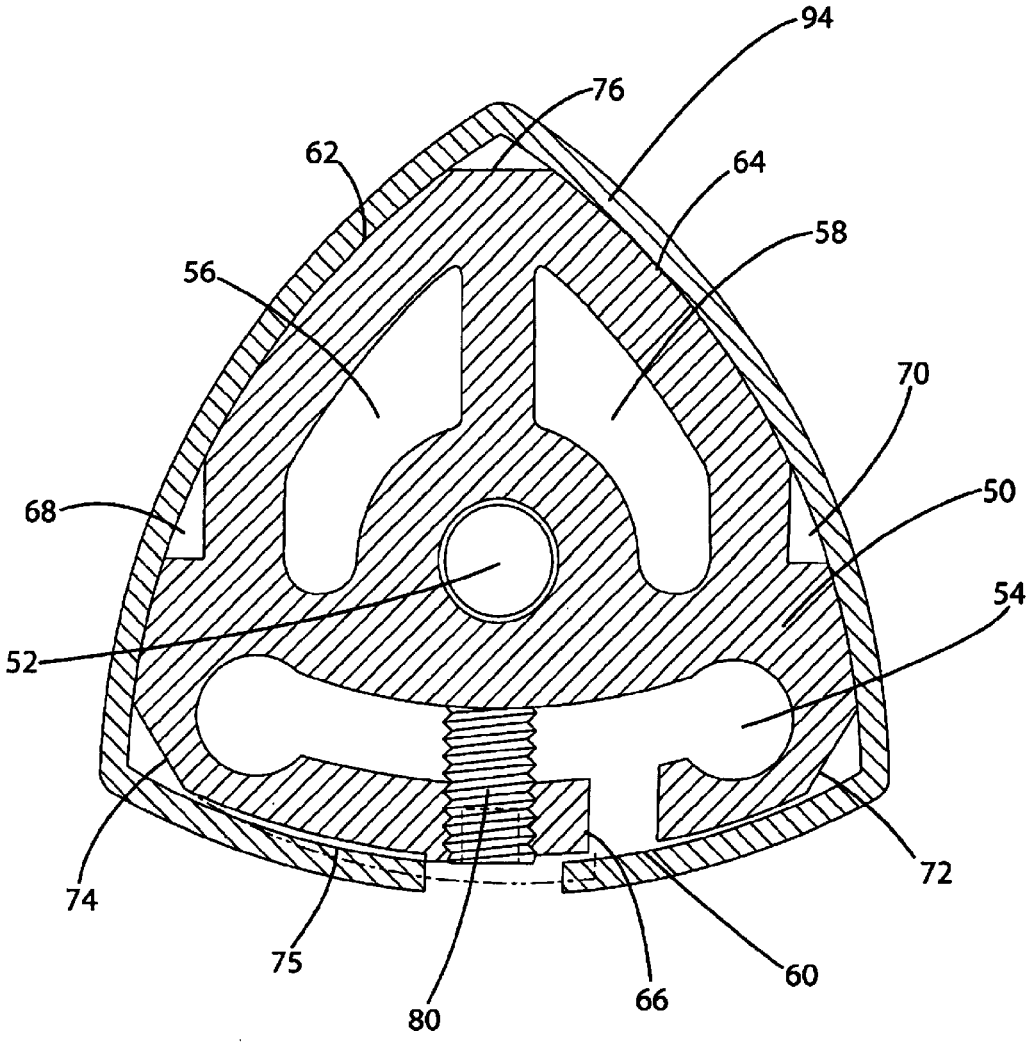
FIG. 7 is a top view of the post with the leg attached.
Figure 8:
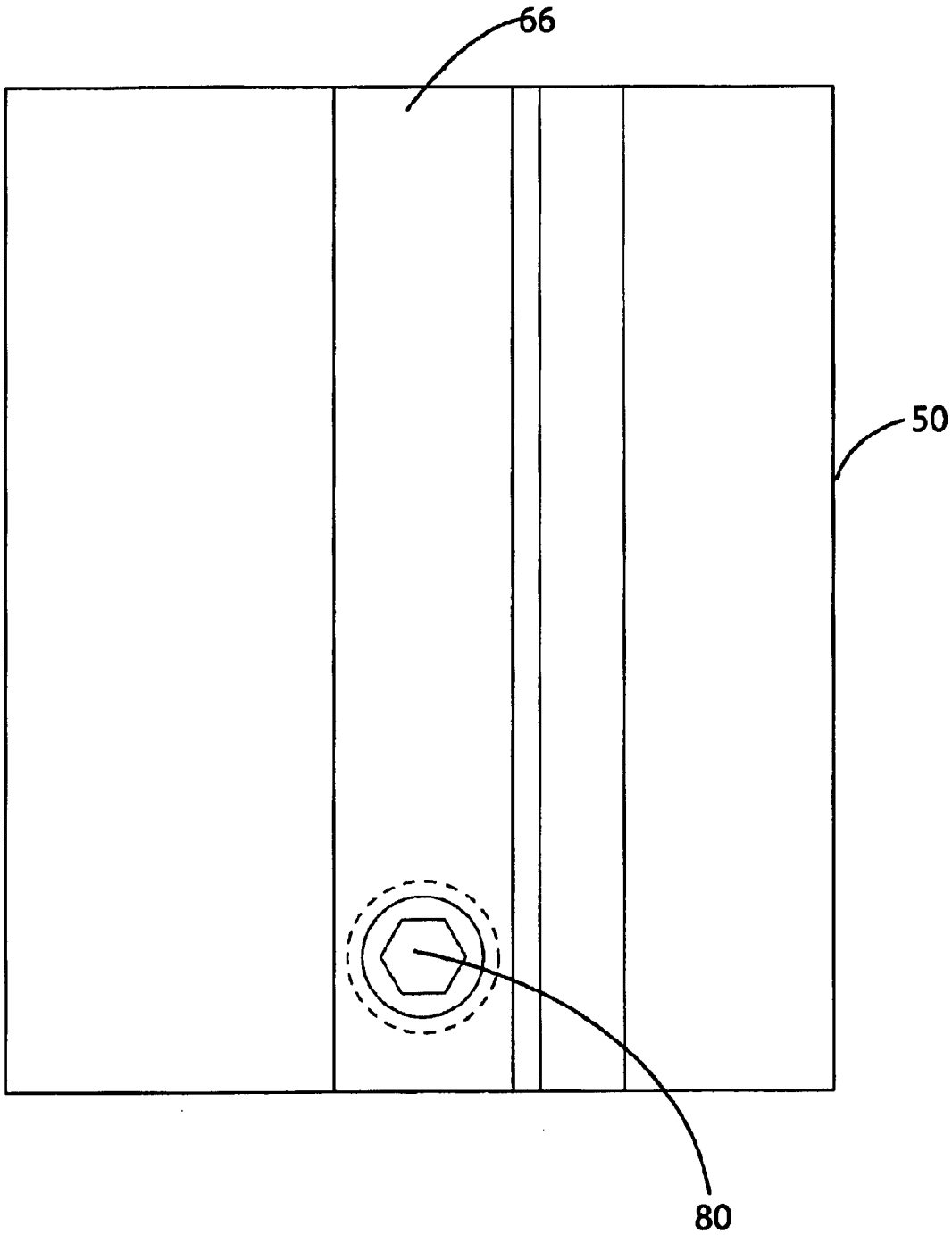
FIG. 8 is a rear view of the post.

A post 50 is secured to the bracket 30 to removably receive the leg 94. The post 50 is preferably extruded from aluminum or other materials of sufficient strength to withstand the forces applied to the leg. The post 50 can alternatively be machined or otherwise fabricated using conventional techniques and apparatus. The post 50 is generally triangular in cross section, having somewhat convex sides 60, 62 and 64 and beveled corners 72, 74, and 76. As shown in FIGS. 6–7, the post 50 defines a central hole 52 that receives a bolt 98 to secure the post 50 to the bracket 30. The post 50 also defines an elongated slot 54 and a channel 66 that cooperate to define a movable wall 75. As shown in FIG. 8, a set screw 80 is threadedly fitted through the movable wall 75. The set screw 80 extends through and abuts the inner wall 55 of the groove 54. As described in more detail below, the movable wall 75 can be flexed outwardly to expand the post 50 by tightening the set screw 80. The post 50 also defines two voids 56, 58 that reduce the weight and material required to form the post 50. The size, number and location of voids can vary from application to application depending in part on the material used and the strength required. Sides 62, 64 of the post 30 each have a channel 68, 70 providing a fixturing surface for machining purposes. As another alternative, the post may be integrally formed with the bracket or may be attached to the bracket using other conventional techniques as will be readily apparent to those skilled in the art.

In a preferred embodiment, a urethane foam 84 covers the brackets 30 and the edge of the table 20 (See FIG. 1). As perhaps best shown in FIG. 3, the foam 84 forms a boot 86 on the underside of the table 20. The foam 84 preferably extends from the top surface of the table 20 over the edge of the table and about halfway down the length of the post 50. This provides the table 20 with a "soft" edge and hides the leg attachment mechanism 10 once the legs 94 are attached. The foam 84 also is located on the underside of the table 20 covering the bracket 30 and extending about halfway down the length of the post 50. The described foam placement is merely exemplary. The configuration of the foam may vary from application to application as desired. Although the foam 84 is preferably a urethane material, it can alternatively be other resilient materials that are capable of being overmolded onto the table 20 and bracket 30.

As noted above, the table 20 includes four legs 94, one supporting each corner of the table 20. The leg 94 is to a large degree conventional, however, it includes a hollow upper end that is shaped to be fitted over the post 50. The leg 94 preferably includes a cross section that corresponds to the cross section of the post 50. More specifically, the leg 94 is preferably somewhat triangular in cross section having convex sides. Unlike the post 50, the corners of the leg 94 are preferably pointed, rather than beveled. One of the sides of the leg 94 defines a hole 96 to allow access to the set screw 80 within the post 50. The leg 94 is preferably includes an upper portion 95 that is extruded from aluminum and a lower portion 97 that is secured to the upper portion 95. The lower portion 97 is preferably adjustable in length to permit separate adjustment of the height of each leg 94.

II. Manufacture

In a preferred embodiment, the brackets 30 are attached on the underside of the table 20 with screws 44. FIG. 5 shows the location of the five screw holes 32, 34, 36, 38 and 40. As noted above, the screw hole 36 is preferably disposed near the tip of the bracket 30 where it will lie beneath the post 50. A metal bolt insert 102 may be preferably installed within the table 20 in alignment with screw hole 36 to enhance the strength of the connection between the bracket 30 and the table 20. The insert 102 is not, however, necessary. Similar metal inserts may be installed in the table 20 to receive the other screws, if desired. Although the position will vary from application to application, four brackets 30 are attached in the four corner of the table 20 so the legs 94 will support the four corners of the table 20. The brackets 30 are preferably casting from aluminum using conventional techniques and apparatus. The bolt hole 42 is preferably tapped after casting. If additional strength is required, an insert (not shown) can be fitted into the bracket 30 about bolt hole 42. The insert can be manufactured from steel or other materials of sufficient strength to bear the load of bolt 98.

Figure 9:
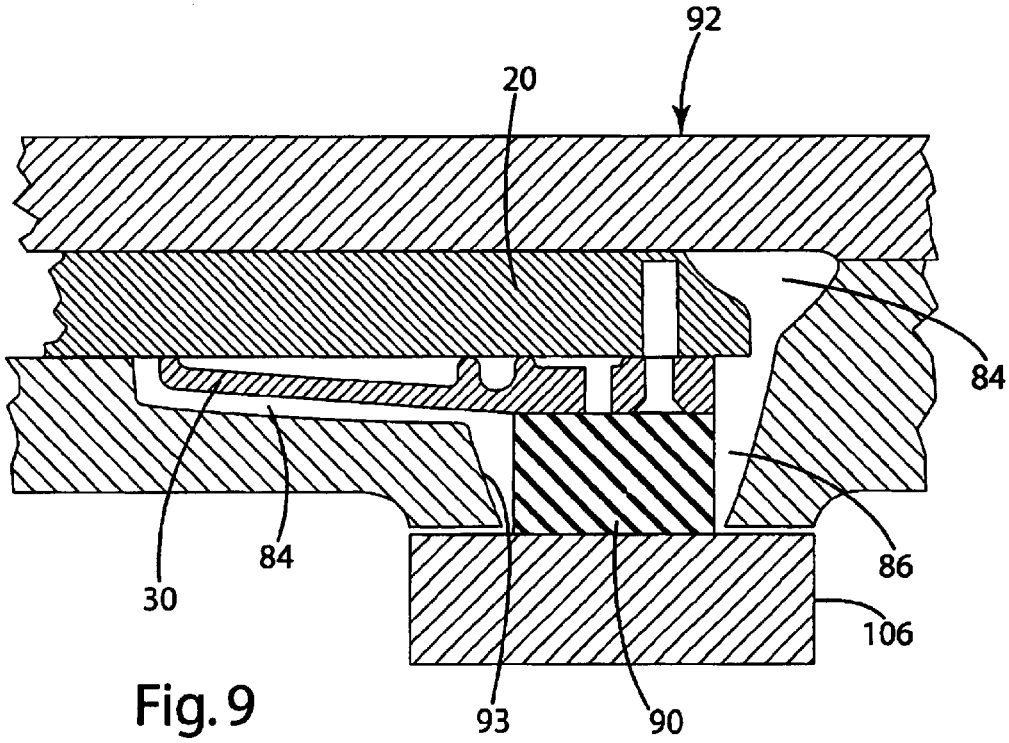
FIG. 9 is a sectional view of the leg attachment mechanism showing the plug insert in an unclamped mold.
Figure 10:
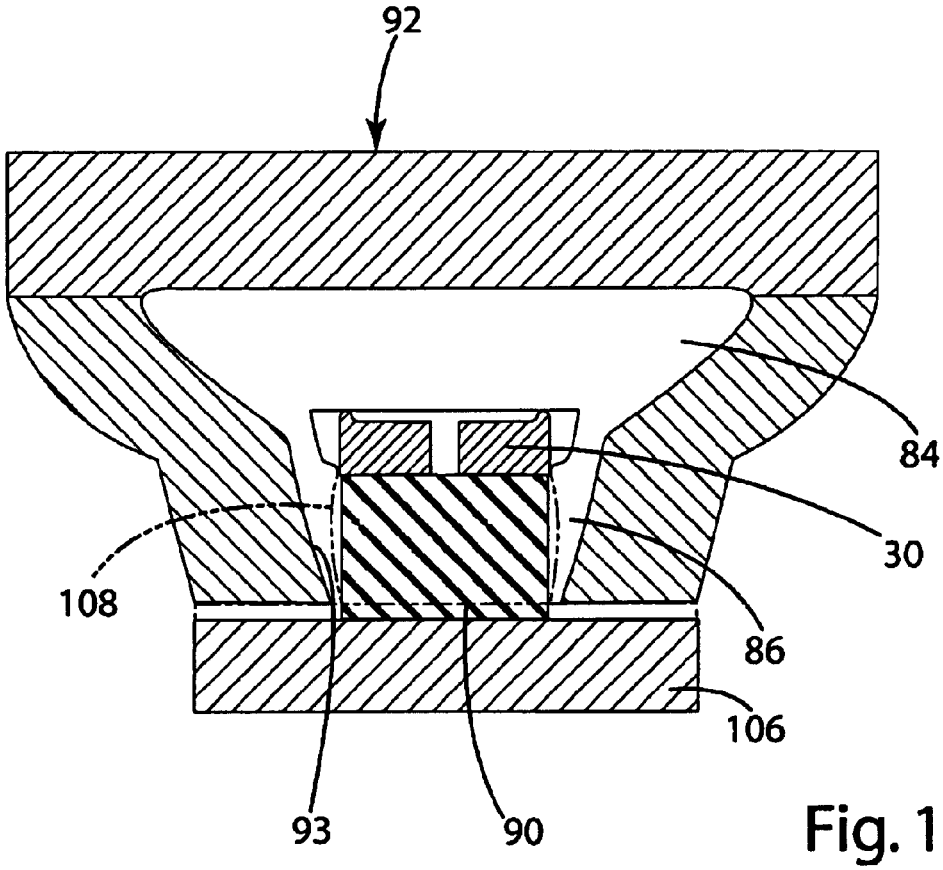
FIG. 10 is a sectional view of the leg attachment mechanism in the clamped mold.

Once the brackets are affixed to the table 20, the edge of the table 20 and the brackets 30 are overmolded with the urethane foam 84. The foam overmold is produced using a relatively large mold 92 capable of closing around the periphery of the table 20. The mold 92 is used to shape the foam into a boot 86 on the underside of the table 20. FIG. 9 and FIG. 10 are cross sectional views of a portion of the mold 92. The mold 92 includes a flexible, resilient plug 90 that is inserted into the mold cavity 93 to define a void where the post 50 will be inserted. The plug 90 is preferably carried on a moving mold part 106 that automates insertion and removal of the plug 92 from the mold cavity 93. The plug 90 is made of silicone that is capable of deforming under pressure. FIG. 10 shows the mold part 106 and the plug 90 in the closed position in phantom lines. As illustrated, in the closed position, the plug 90 is compressed between the mold part 106 and the bracket 30. This causes the sides of the plug 90 to bulge outwardly. The urethane foam is injected into the mold 92 while the plug 90 is maintained in a bulged shape. Because the plug 90 bulges out in the mold 92, an undercut 108 is created in the foam 84. When the foam is sufficiently cured, the plug 90 is removed from the mold cavity 93. As the mold part 106 moves away from the mold 92, the pressure on the plug 90 is removed and it returns to it original, non-bulged shape. This permits the plug 90 to be withdrawn through the opening in the boot. The undercut 108 reduces the amount of force required to insert a leg 94 into the leg attachment mechanism 10 because it reduces the amount of surface to surface contact between the leg 94 and the boot 86. Also, because of the undercut, a draft angle is not needed in the foam 84 and the fit between the leg 94 and the boot 86 is improved. Although the overmold is preferably a conventional urethane foam, other similar materials capable of overmolding can be used in the alternative.

The post 50 is preferably manufactured using conventional extrusion techniques and apparatus. The post extrusion is cut to the desired length and the set screw hole is drilled and tapped in the movable wall 75. The post 50 is then ready to be attached to a bracket 30.

The posts 50 are attached to the brackets 30 after the overmolding process is complete. Each post 50 is preferably attached to the corresponding bracket 30 using a bolt 98 or other conventional fastener. The bolt 98 is inserted into the post 52 through the bolt hole 52, and then threaded into the bolt hole 42 in the bracket 30. In the preferred embodiment, the foam boot 86 surrounds approximately the top half of the post 50. However, the size and configuration of the boot 86 may vary from application to application as desired. For example, the boot may alternatively be of sufficient size to cover the set screw access opening in the leg. In this alternative embodiment (not shown), the boot will also include a set screw access opening. Because of the flexible nature of the foam, the set screw access opening can be stretched when access to the set screw is desired. Accordingly, the smaller set screw opening can be smaller than would be necessary with rigid materials.

The legs 94 are preferably attached to the table 20 after the product has been delivered to the point of use. To attach a leg 94, he hollow, upper end of the leg 94 is fitted around the post 50. The leg 94 is positioned so that the leg hole 96 is aligned with the set screw 80 in the post 50. The set screw 80 is then turned causing the movable wall 75 to flex outwardly from the remainder of the post 50 in increasingly forceful engagement with the inner surface of the leg 94. This force causes the walls of the leg 94 to wrap tightly around the somewhat convex walls of the post 50 in a wedge-like action. The high level of force and high degree of contact between the post 50 and the leg 94 securely attaches the leg 94 to the table 20. The upper end of the leg 94 is preferably fitted within foam boot 86.

The present invention is adapted for attachment of legs to various articles of furniture, such as tables. The leg attachment mechanism may come is various sizes and include brackets of different shapes to fit different types of furniture.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A leg attachment mechanism for an article of furniture comprising:

a bracket secured to the article of furniture;

a post extending from said bracket in a longitudinal direction, said post defining a cross section being generally wedge-shaped alone a plane generally perpendicular to said longitudinal direction;

a leg defining a receptacle, said receptacle receiving said post, wherein said cross section of said post can be selectively actuated between a first configuration in which said post fits substantially freely within said receptacle, and a second configuration in which said cross section of said post is expanded from said first configuration so that said post forcefully engages a surface defining said receptacle, whereby expansion of said cross section securely attaches said leg to said post.

2. The leg attachment mechanism of claim 1 wherein said post cross section includes first and second fixed walls and a movable wall, said receptacle corresponding in shape to said post cross section, said post cross section expanding by movement of said movable wall, said movement causing said first and second fixed walls to forcefully engage said receptacle surface to securely attach said leg to said post.

3. The leg attachment mechanism of claim 2 wherein said post includes a flexible wall capable of inward and outward movement, said post including means for controlling a position of said flexible wall.

4. The leg attachment mechanism of claim 3 wherein said post cross section is substantially triangular.

5. A leg attachment mechanism for an article of furniture comprising:

a bracket secured to the article of furniture;

a post extending from said bracket, wherein said post defines a cross section that is generally wedge-shaped, wherein said post cross section is substantially triangular, wherein said post includes a corner opposite said flexible wall, said corner being beveled, and wherein said post includes a flexible wall capable of inward and outward movement, said post including means for controlling a position of said flexible wall;

a leg defining a receptacle, said receptacle corresponding in shape to said post cross section, said receptacle receiving said post, wherein said post cross section can be selectively actuated between a first configuration in which said post fits substantially freely within said receptacle, and a second configuration in which said cross section of said post is expanded from said first configuration so that said post forcefully engages a surface defining said receptacle, whereby expansion of said cross section securely attaches said leg to said post.

6. The leg attachment mechanism of claim 5 wherein said post is manufactured separately from said bracket.

7. The leg attachment mechanism of claim 6 wherein said bracket is secured to the article of furniture by at least one fastener said fastener, being disposed beneath said post.

8. The leg attachment mechanism of claim 7 wherein said fastener is disposed at a tip of said bracket.

9. The leg attachment mechanism of claim 8 wherein said post includes a mounting hole extruded substantially centrally through said post, said post being affixed to said bracket by a fastener extending through said mounting hole.

10. The leg attachment mechanism of claim 9 wherein said post includes substantially convex walls.

11. The leg attachment mechanism of claim 10 wherein said post cross section is expanded from said first configuration to said second configuration by an element threadedly passing through said flexible wall and engaging a fixed surface on said post, whereby rotational movement of said element in a first direction causes said flexible wall to move outwardly expanding said post.

12. A method of manufacturing an article of furniture comprising:

attaching a bracket to the article of furniture;

inserting the article of furniture into a mold that extends around and encapsulates at least a portion of an edge of said article of furniture;

forming an overmold over the bracket and an edge of the article of furniture by injecting a material into said mold, the overmold including a boot adapted to closely receive a leg;

attaching a post to the bracket within the boot; and attaching a leg to the post, the leg being fitted over the post within the boot, whereby the overmold provides the article of furniture with a resilient edge while providing a pleasing aesthetic appearance.

13. The method of claim 12 wherein step of forming an overmold includes the steps of:

inserting a flexible, resilient plug into the mold, the plug substantially corresponding in cross sectional shape to the post;

compressing the plug within the mold such that the plug bulges;

injecting foam into the mold while the plug remains bulged;

permitting the foam to cure while the plug remains bulged to define an undercut in the boot, such that the cured foam defines a cavity in the shape of the compressed plug.

14. The method of claim 13 wherein the post is expandable and the leg includes a receptacle of sufficient dimension to receive the post, said leg attaching step including the steps of:

fitting the receptacle over the post; and expanding the post within the receptacle until the post is firmly and securely engaged with the receptacle.

15. The method of claim 14 wherein the post includes a flexible wall that is capable of inward and outward movement, said post expanding step including moving the flexible wall outwardly.

16. The method of claim 15 wherein the post includes a threaded element extending through said flexible wall and engaging a fixed portion of the post, said post expanding step including rotating said threaded element.

17. The method of claim 16 wherein the bracket is secured to the article of furniture by a fastener prior to said post attachment step, the fastener being disposed to lie beneath the post once said post is attached to said bracket.

18. The method of claim 17 wherein the post and the receptacle are generally triangular in cross section.

19. The method of claim 18 wherein the post includes generally convex side walls, the post further including a beveled corner opposite the flexible wall.

20. An article of furniture comprising:

a surface;

a bracket connected to said surface;

a foam overmold molded over said bracket, wherein said overmold is molded in situ over at least a portion of said surface, said overmold defining a boot;

a post extending from said bracket within said boot; and a leg affixed to said post within said boot, said leg defining a receptacle fitted over said post.

21. The article of furniture of claim 20 wherein said boot is undercut.

22. The article of furniture of claim 21 wherein said post is generally wedge-shaped, said receptacle corresponding in shape to said post.

23. The article of furniture of claim 22 further comprising means for selectively expanding said post, said means permitting selective expansion of said post from a first configuration in which said post fits substantially freely within said receptacle and a second configuration in which said post is expanded to forcefully engage a surface defining said receptacle, whereby expansion of said post securely attaches said leg to said post.

24. The article of furniture of claim 23 wherein said post includes a flexible wall capable of outward flexing movement, said means for selectively expanding said post including means for controlling a position of said flexible wall.

25. The article of furniture of claim 24 wherein said post includes a corner opposite said flexible wall, said corner being beveled.

26. The article of furniture of claim 25 wherein said post is substantially triangular in cross section.

27. The article of furniture of claim 26 wherein said post is manufactured separately from said bracket.

28. The article of furniture of claim 27 wherein said bracket is secured to the article of furniture by at least one fastener, said fastener being disposed beneath said post.

29. The article of furniture of claim 28 wherein said fastener is disposed at a tip of said bracket.

30. The article of furniture of claim 29 wherein said post includes amounting hole extruded substantially centrally through said post, said post being affixed to said bracket by a fastener extending through said mounting hole.

31. The article of furniture of claim 30 wherein said post and said receptacle include substantially convex walls.

32. The article of furniture of claim 31 wherein said post expanding means includes an element threadedly passing through said flexible wall and engaging a fixed surface on said post, whereby rotational movement of said element in a first direction cause said flexible wall to move outwardly, thereby expanding said post.

33. The article of furniture of claim 32 wherein said post expanding means includes a set screw threadedly mounted within said flexible wall.

34. The article of furniture of claim 33 wherein said flexible wall is defined by a pair of intersecting voids extruded into the post, whereby said flexible wall is an integral portion of said post.

35. A leg attachment mechanism for an article of furniture comprising:

a bracket secured to the article of furniture;

a post extending from said bracket, in a longitudinal direction, said post defining a cross section being generally wedge-shaped along a plane generally perpendicular to said longitudinal direction;

a leg defining a receptacle, said receptacle receiving said post;

means for selectively expanding said post, said means permitting selective increase of said post from a first configuration in which said post fits substantially freely within said receptacle, to a second configuration in which said post is expanded to forcefully engage a surface defining said receptacle, whereby expansion of said post securely attaches said leg to said post.

* * * * *

UNITED STATES PATENT AND TRADEMARK OFFICE

CERTIFICATE OF CORRECTION

PATENT NO. : 6,925,945 B2
DATED : August 9, 2005
INVENTOR(S) : Tod G. Babick et al.

It is certified that error appears in the above-identified patent and that said Letters Patent is hereby corrected as shown below:

Column 6,
Line 28, “alone” should be -- along --.

Column 7,
Line 11, insert -- , -- after first occurrence of “fastener” and delete “,” after second occurrence of “fastener”.

Column 8,
Line 54, “amounting” should be -- a mounting --.

Signed and Sealed this

Twenty-ninth Day of November, 2005

JON W. DUDAS
*Director of the United States Patent and Trademark Office*